US005833504A

United States Patent [19]

Ikeya et al.

[11] Patent Number: 5,833,504

[45] Date of Patent: Nov. 10, 1998

[54] AIR INTAKE DEVICE FOR OUTBOARD BOAT ENGINE

[75] Inventors: Toshiaki Ikeya; Mitsuhiko Ohta; Naoki Kawasaki, all of Shizuoka-ken, Japan

[73] Assignee: Suzuki Motor Corporation, Japan

[21] Appl. No.: 846,534

[22] Filed: Apr. 29, 1997

[30] Foreign Application Priority Data

Apr. 30, 1996 [JP] Japan ..... 8-109533

[51] Int. Cl.[6] ..... B63H 21/10

[52] U.S. Cl. ..... 440/88; 123/184.21

[58] Field of Search ..... 440/88, 89, 900; 123/195 C, 184.21

[56] References Cited

U.S. PATENT DOCUMENTS

| | | | |
|---|---|---|---|
| 3,114,669 | 12/1963 | Herbst | 123/184.21 |
| 4,716,878 | 1/1988 | Shimada et al. | 123/184.21 |
| 4,898,125 | 2/1990 | Ampferer | 123/184.21 |

*Primary Examiner*—Jesus D. Sotelo

*Attorney, Agent, or Firm*—Finnegan, Henderson, Farabow, Garrett & Dunner, L.L.P.

[57] ABSTRACT

An air intake device for a vertically oriented multi-cylinder outboard boat engine having an engine block, a crank case, and vertically spaced fuel intake ports. The air intake device includes a surge tank attached to the crank case and having vertically spaced air intake pipes extending from the surge tank to the engine intake ports. An insulation layer is mounted between the surge tank and the crank case.

6 Claims, 6 Drawing Sheets

AIR INTAKE DEVICE FOR OUTBOARD BOAT ENGINE

BACKGROUND OF THE INVENTION

1. Field of Invention

This invention concerns an outboard boat engine air intake device. More particularly, this invention relates to an air intake device that reduces the transfer of heat from the engine to the surge tank.

2. Description of Related Art

In recent years, fuel injection air intake devices have also become widely used in outboard boat engines. Fuel injection air intake devices include a surge tank that regulates the air flow, as well as air intake pipes that extend substantially horizontally in multiple vertical stages from the surge tank to the respective intake ports of the engine and fuel injectors that inject fuel into the intake ports. Furthermore, a throttle valve provided in the surge tank regulates the amount of air taken into the system.

When the throttle valve opens, fresh air flows into the surge tank, through the various intake pipes, and into the engine intake ports. Fuel injected by the injectors near the intake ports flows into and is mixed with the fresh air to create a combustible gaseous mixture taken into the engine. A breather pipe extends from the engine cylinder head and is connected to the throttle valve.

With this type of outboard boat engine air intake device, the surge tank is attached to the crank case, which is attached directly to the engine. Heat generated by the engine is thereby transmitted to the surge tank. This increases the temperature of air taken into the surge tank, thus decreasing the air density, and the efficiency with which air is replenished to the engine.

Another problem encountered in conventional air intake devices is water or other fluid leaking into the area where the surge tank attaches to the crank case.

Yet another problem encountered in conventional air intake devices is the difficulty of attaching the surge tank to the engine during assembly.

Thus an outboard boat motor air intake device is needed that reduces the transfer of heat from the engine to the surge tank. Also, an air intake device is needed that reduces access to water and other fluids in the area where the surge tank attaches to the crank case. And, finally, an air intake device is needed that can be easily attached to the engine during assembly.

SUMMARY OF THE INVENTION

Accordingly, the present invention is directed to an air intake device for an outboard boat engine that substantially obviates one or more of the problems due to the limitations and disadvantages of the related art.

Additional features and advantages of the invention will be set forth in the description which follows, and in part will be apparent from the description, or may be learned by practice of the invention. The objectives and advantages of the invention will be realized and obtained by means of the combinations particularly pointed out in the written description and claims hereof as well as the appended drawings.

To achieve these and other advantages and in accordance with the purpose of the invention, as embodied and broadly described, the invention includes an air intake device for a vertically oriented multi-cylinder outboard boat engine having an engine block, a crank case, and vertically spaced fuel intake ports. The invention further includes an air intake device having a surge tank attached to the crank case and having a plurality of vertically spaced air intake pipes extending from the surge tank to the engine intake ports. Further, the crank case is attached to the engine block. Still further, an insulation layer is mounted between the surge tank and the crank case.

In another aspect of the invention, the insulation layer can be made of a heat resistant synthetic resin. Further, the insulation layer can be formed as a single piece of material.

In another aspect of the invention, the insulation layer is formed as individual washer-shaped rings.

In still another aspect of the invention, the insulation layer overlays the top of the engine and is substantially perpendicular to the flywheel. Therefore, seawater, lake water, or other undesirable fluids are prevented from contacting the insulation layer thereby improving the waterproofness of the components by which the surge tank is attached.

In another aspect of this invention, the surge tank is attached to the crank case by bolts that run in the same direction as the bolts that fasten the engine block to the crank case, thus the surge tank to the crank case can be screwed in simultaneously, thereby improving the ease of surge tank attachment.

It is to be understood that both the foregoing general description and the following detailed description are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate several embodiments of the invention and together with the description serve to explain the principles of the invention. In the drawings.

DETAILED DESCRIPTION OF THE PREFERRED EMBODIMENTS

Reference will now be made in detail to the present preferred embodiments of the invention, examples of which are illustrated in the accompanying drawings.

Figure 1:
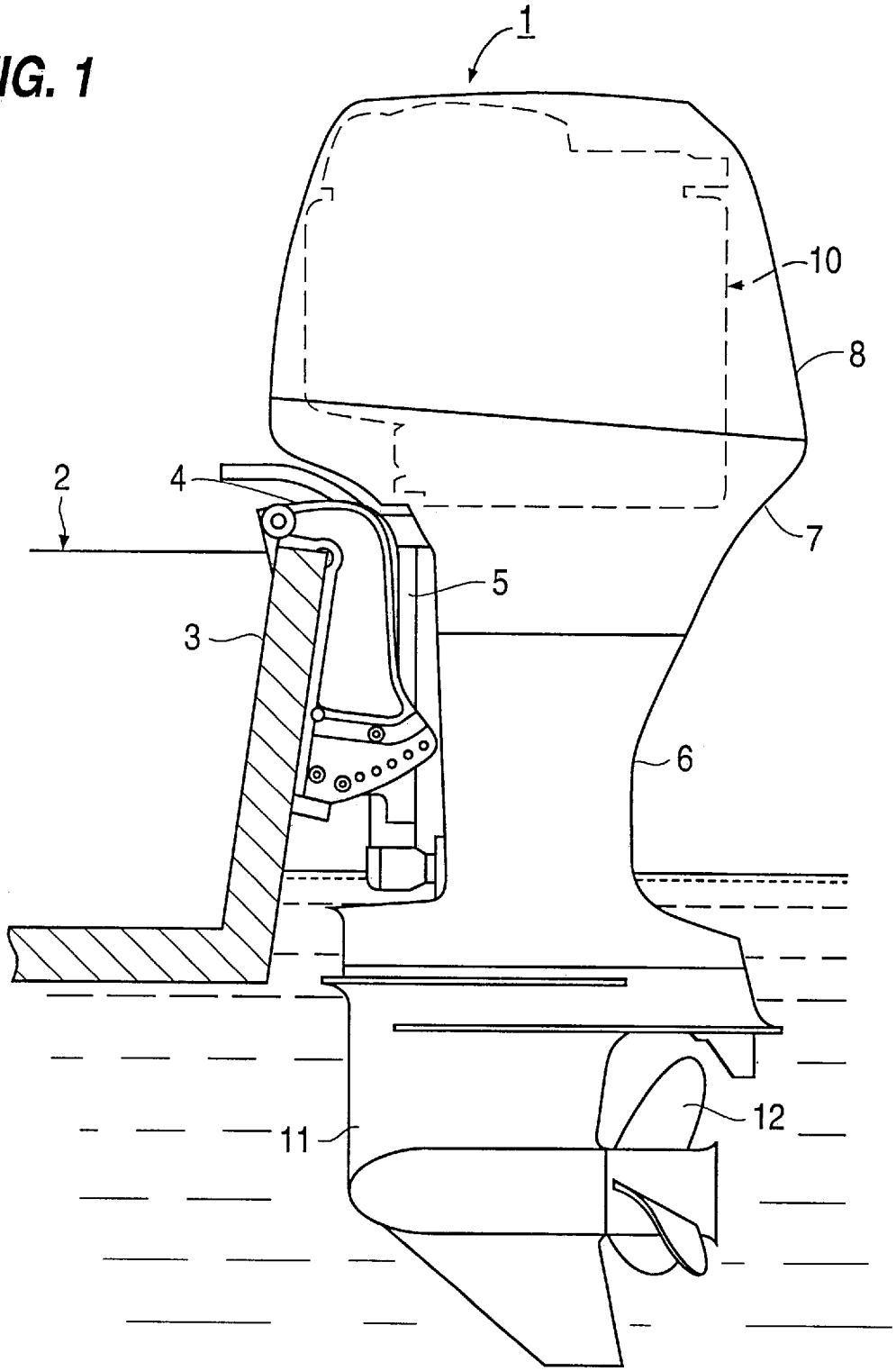
FIG. 1 is a side view of one example of an outboard motor wherein the air intake device of this invention is used.

As shown in FIG. 1, an outboard boat motor 1 is mounted on a transom 3 on the body of a boat 2 by a clamp bracket 4 so that the motor can pivot freely on a swivel shaft 5 secured to the motor 1.

A drive housing 6, which occupies the center of the outboard boat motor 1, is joined to the clamp bracket 4 by the swivel shaft 5. Located above the drive housing 6 is a two-part engine cover 7, 8 in which an engine 10 is stored. The engine 10 is housed such that the crank shaft thereof (not shown) is vertically oriented.

A gear case 11 is provided in the lower part of the drive shaft housing 6, and a propeller 12 is supported by a shaft (not shown) in the back of the gear case 11. Moreover, the propeller 12 is rotationally driven by a drive shaft that extends vertically downward from the engine 10.

Figure 2:
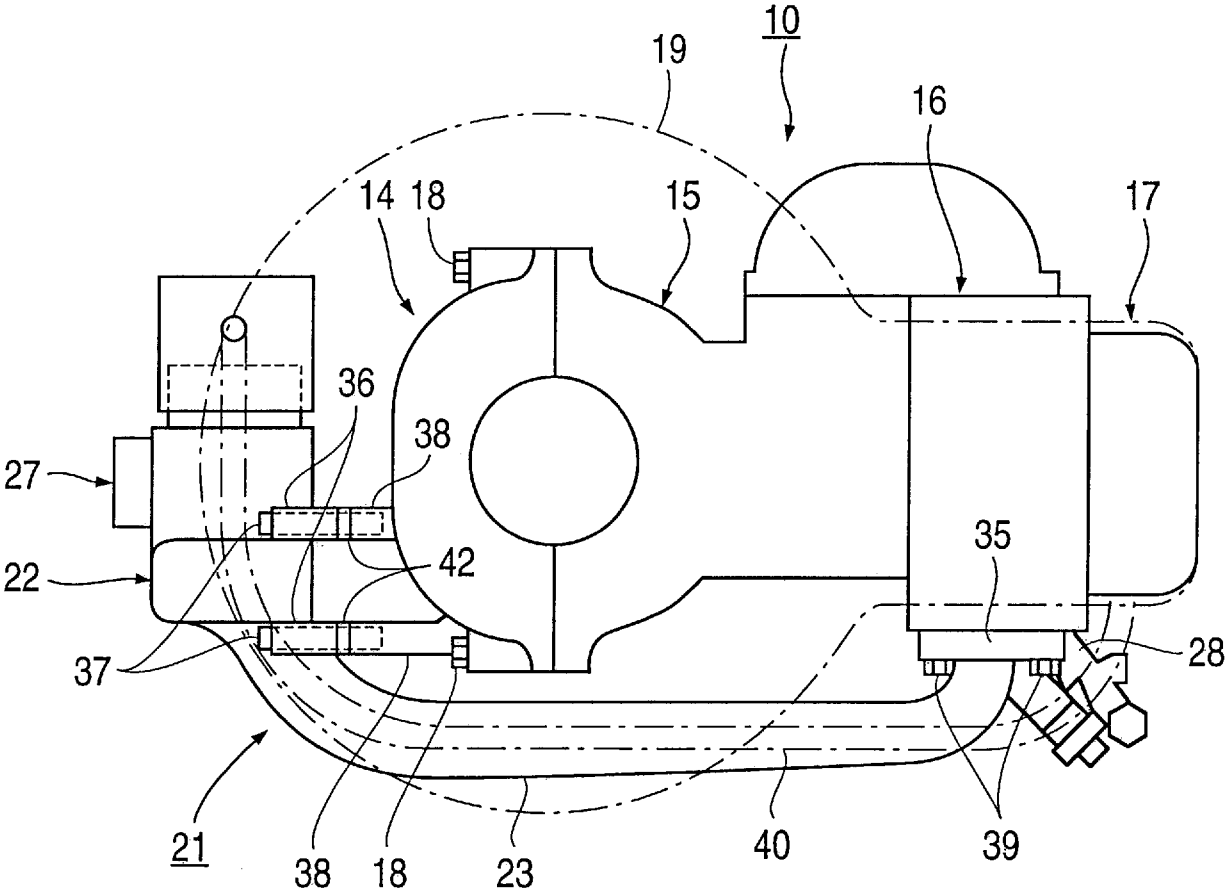
FIG. 2 is a top view of an engine.
Figure 3:
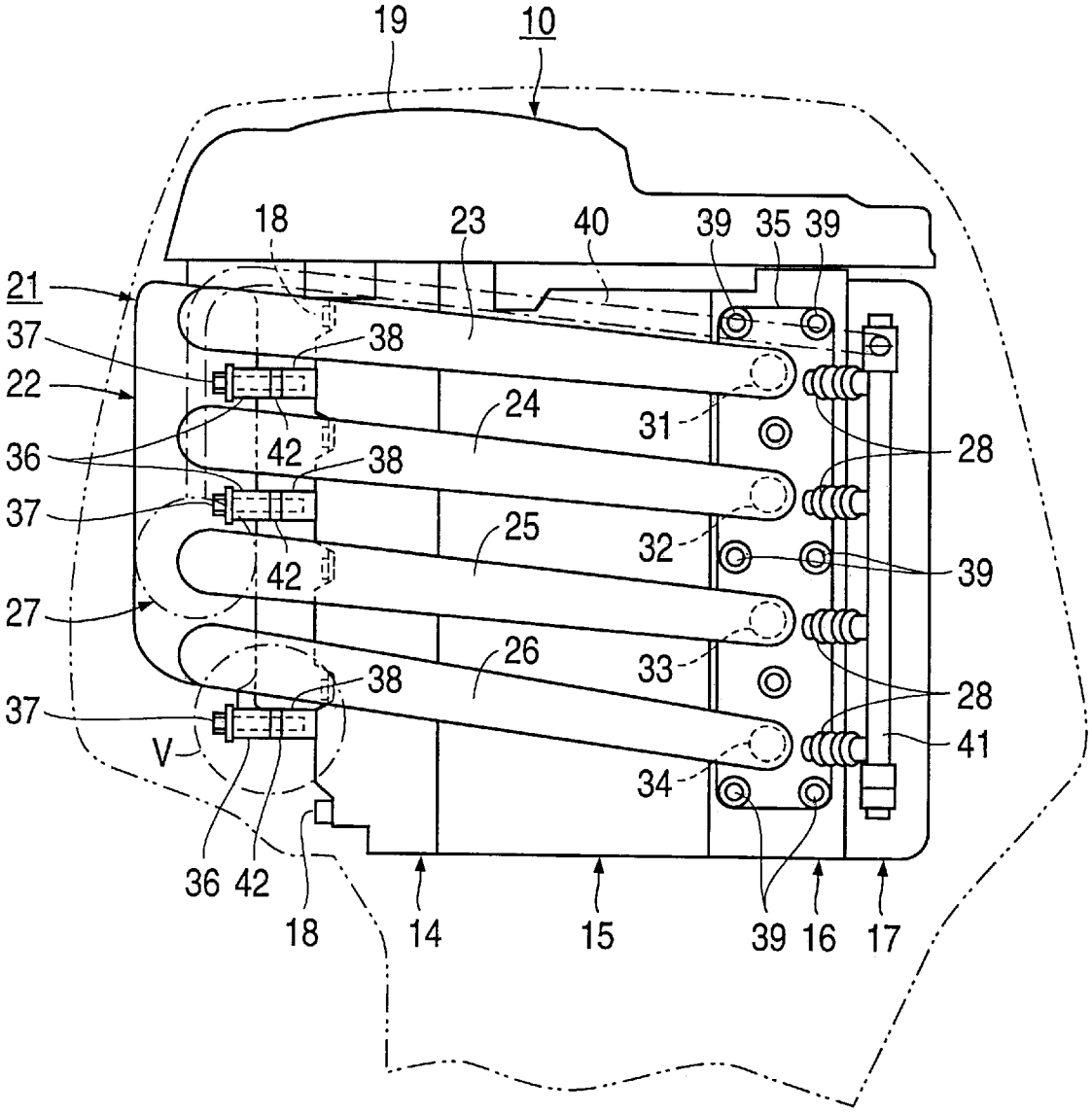
FIG. 3 is a side view of an engine.
Figure 4:
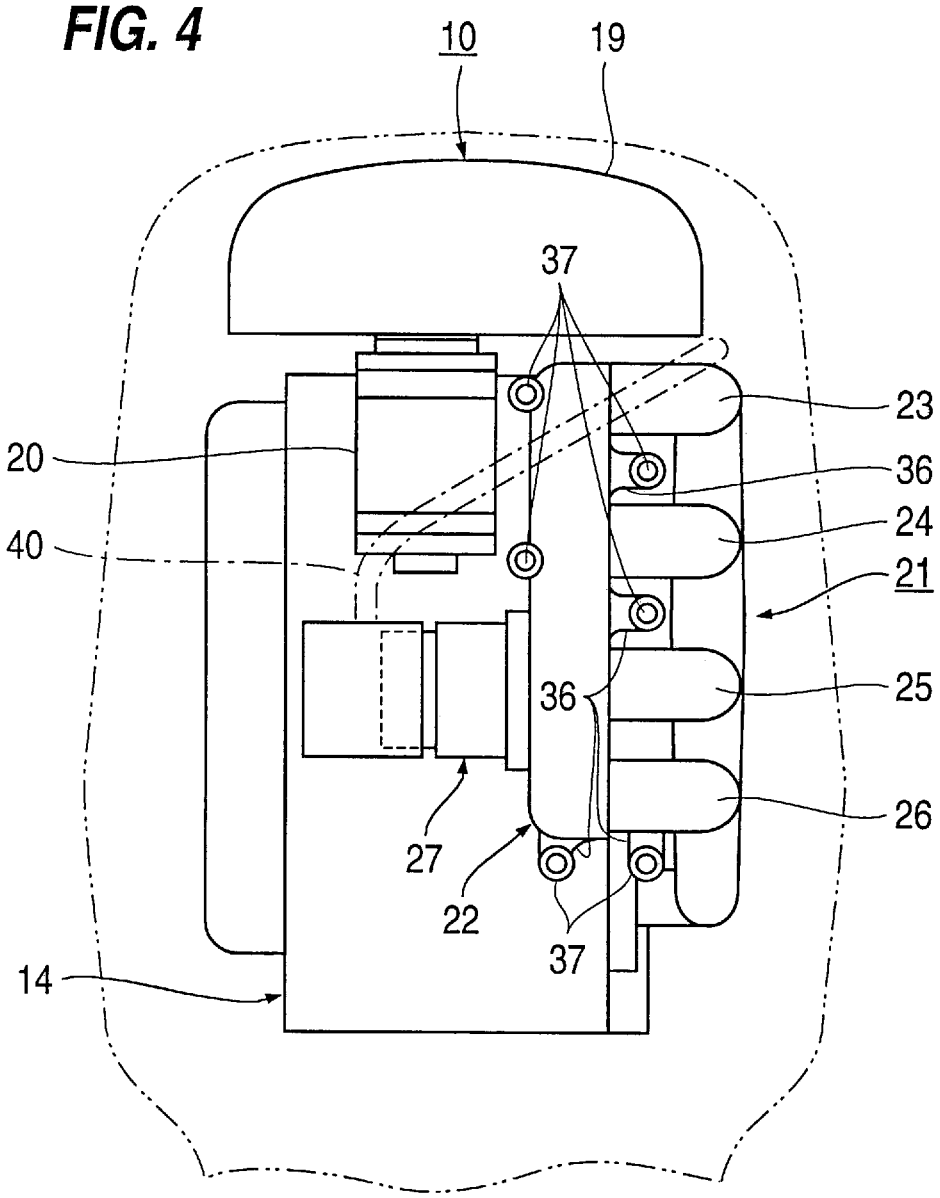
FIG. 4 is a frontal view of the engine.

As shown in FIGS. 2–4, the engine 10 is a four-cycle gasoline engine including a crank case 14 in which a crank shaft extends vertically, a cylinder block 15, a cylinder head 16, and a head cover 17 attached by bolts 18 to the crank case 14. A flywheel cover 19 overlying a flywheel (not shown) is mounted on top of the engine 10.

In accordance with the invention, an outboard boat engine air intake device is provided. The air intake device of this invention includes a surge tank 22 attached to the front of the crank case 14 to regulate the supply of combustion air to the engine. A plurality of air intake pipes 23–26 extend from the left side of the surge tank 22. A single throttle valve 27 controls the amount of air taken into the surge tank 22. It is preferred that the plurality of air intake pipes 23–26 are arranged in vertical stages to facilitate connection of the air intake pipes 23–26 to respective air intake ports 31–34 opened in the left side of the cylinder head 16.

The front ends of the air intake pipes 23–26 are mounted in a single intake manifold cover 35, which is connected by bolts 37 to the cylinder head 16. Also, connection bushings 36 on the surge tank 22 are connected to corresponding bosses 38 on the crank case 14 by bolts 37. It is preferred that the throttle valve 27, which regulates the amount of air taken into the surge tank 22, be located on the side of the surge tank 22. A breather pipe 40, which extends from the cylinder head 16, is connected to the throttle valve 27. Also, fuel injectors 28, with an associated fuel delivery pipe 41, are mounted in the intake manifold cover 35 so they face the interior of the intake ports 31–34.

When the throttle valve 27 opens, fresh air flows into the surge tank 22, then through the respective intake pipes 23–26, and into the intake ports 31–34. Fuel, injected from the fuel injectors 28 and into the intake ports 31–34, is blended with the fresh air to create a combustible gaseous mixture, which is then taken into the engine 10.

Because the surge tank is attached directly to the crank case 14, which is attached to the engine block 10, heat generated by the engine block 10 is transmitted to the surge tank 22. This increases the temperature of the air entering the surge tank 22, decreases the air density and, thus, decreases the efficiency with which the air is replenished to the engine 10.

Figure 5:
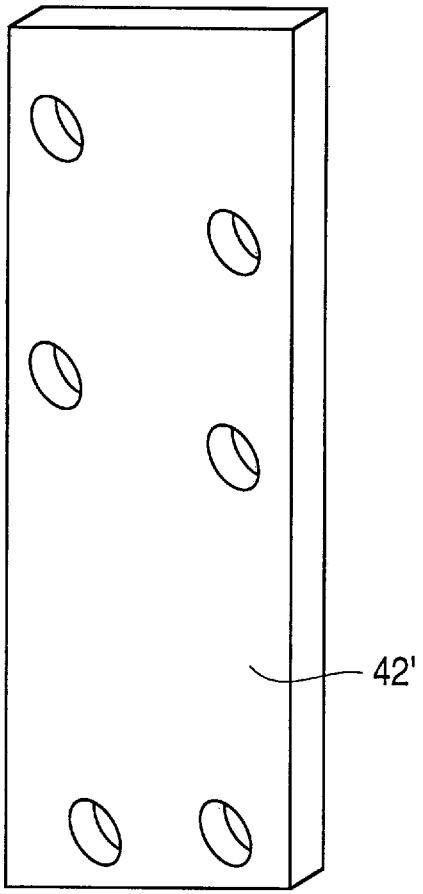
FIG. 5 is a perspective view of a modified embodiment of a heat insulation layer.

In accordance with the present invention, as shown in FIGS. 2, 3 and 5, it is preferred that an insulation layer 42 be mounted between the six attachment bushings 36 of the surge tank 22 and the internally threaded attachment platform 38 of the crank case 14. Thus, when the surge tank 22 is attached to the crank case 14 with six bolts 37, the insulation layer 42 will be held firmly in place. It is preferred that the insulation layer be made of a heat resistant synthetic resin. Consequently, heat from the crank case 14 is blocked by the insulation material 42 and cannot be transmitted to the surge tank 22, thus controlling the air density of air taken into the surge tank 22, therefore, preventing a decrease in air temperature and improving the efficiency with which air is taken into the engine 10.

It is further preferred that the insulation layer be formed as a single piece of material. As shown in FIG. 5, the insulation layer is embodied as an apertured plate 42.

Figure 6:
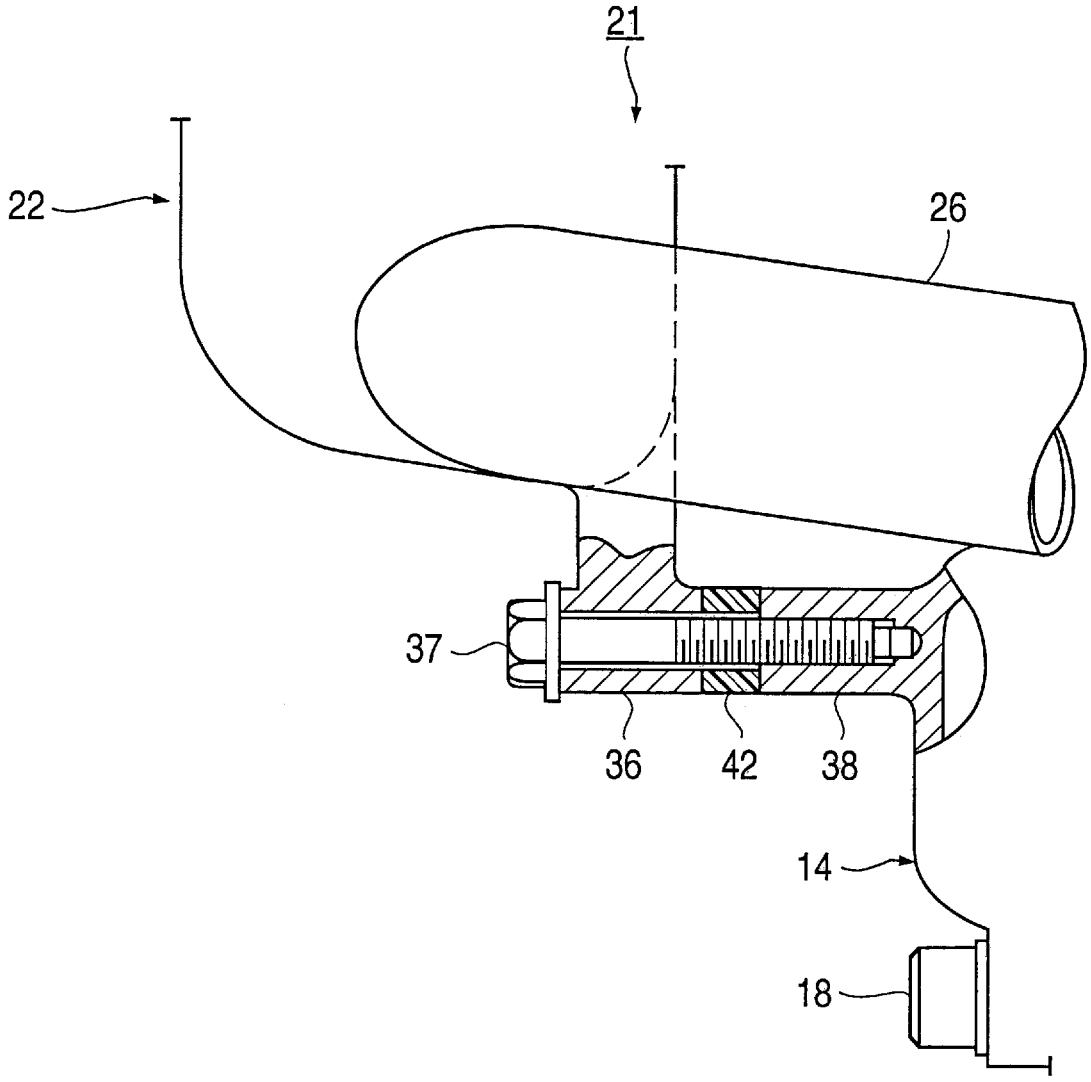
FIG. 6 is an enlarged partial cross-sectional view of components within the sight circle of FIG. 3.

In another embodiment, shown in FIG. 6, it is preferred that the insulation layer 42 be formed as individual washer-shaped rings mounted at the connection points between the surge tank 22 and the crank case 14.

It is also preferable that the insulation layer be located under a flywheel cover 19 that overlays the top of the engine 10 and, moreover, located substantially perpendicular to the flywheel cover 19. The attachment bosses 36 formed in the surge tank, the internally threaded attachment platform formed in the crank case 14, and the bolts 37 are all located substantially perpendicular to the flywheel cover 19. Such a configuration enhances the prevention of seawater, lake water, and other undesirable fluids from contacting the washer-shaped insulation material 42, thereby improving the waterproofness of the components by which the surge tank 22 is attached.

It is further preferable that the feed direction of the bolts 37 that attach the surge tank 22 run in the same direction as the bolts 18 that attach the crank case 22 to the engine block. Thus, when an engine is assembled, the bolts 18 that attach the crank case 14 and the bolts 37 that attach the surge tank 22 can be screwed in simultaneously, thereby improving the ease of attaching the surge tank 22.

It will be apparent to those skilled in the art that various modifications and variations can be made in the air intake device for a boat engine of this device of the present invention without departing from the spirit or scope of the invention. Thus it is intended that the present invention cover such modifications and variations of this invention provided they come within the scope of the appended claims and their equivalents.

I claim:

1. An air intake device for a vertically oriented multi-cylinder outboard boat engine having an engine block, a crank case, and vertically spaced fuel intake ports, said air intake device comprising:

a surge tank attached to said crank case and having a plurality of vertically spaced air intake pipes extending from said surge tank to the engine intake ports; and said crank case attached to said engine block wherein an insulation layer is mounted between said surge tank and said crank case.

2. The air intake device of claim 1 wherein the insulation layer is made of a heat resistant synthetic resin.

3. The air intake device of claim 1 wherein the insulation layer is formed as a single piece of material.

4. The air intake device of claim 1 wherein the insulation layer is formed as individual washer-shaped rings.

5. The air intake device of claim 1 wherein the insulating layer overlays the top of said engine and is substantially perpendicular to a flywheel cover.

6. The air intake device of claim 1 wherein said surge tank is attached by bolts to a crank case, and said crank case is attached to said engine by bolts that runs in the same direction as said surge tank bolts.

* * * * *

UNITED STATES PATENT AND TRADEMARK OFFICE

CERTIFICATE OF CORRECTION

PATENT NO. : 5,833,504

DATED : November 10, 1998

INVENTOR(S) : Ikeya, Toshiaki et al

It is certified that error appears in the above-indentified patent and that said Letters Patent is hereby corrected as shown below:

Claim 6, col. 4, line 56, "runs" should read --run--.

Signed and Sealed this

Twenty-third Day of March, 1999

*Attest:*

Q. TODD DICKINSON

*Attesting Officer*

*Acting Commissioner of Patents and Trademarks*